US008221869B2

(12) United States Patent
Pare

(10) Patent No.: US 8,221,869 B2
(45) Date of Patent: Jul. 17, 2012

(54) STACK-TOP DUNNAGE

(75) Inventor: Eric Pare, Quebec (CA)

(73) Assignee: Cascades Canada, Inc., Quebec (CA)

( * ) Notice: Subject to any disclaimer, the term of this patent is extended or adjusted under 35 U.S.C. 154(b) by 321 days.

(21) Appl. No.: 12/752,197

(22) Filed: Apr. 1, 2010

(65) Prior Publication Data

US 2010/0293890 A1 Nov. 25, 2010

Related U.S. Application Data

(60) Provisional application No. 61/180,633, filed on May 22, 2009.

(51) Int. Cl.
*B65D 19/38* (2006.01)

(52) U.S. Cl. ..... 428/126; 108/51.3; 108/55.1

(58) Field of Classification Search ..... 428/126, 428/127, 128; 108/51.3, 55.1; 206/386, 206/586

See application file for complete search history.

(56) References Cited

U.S. PATENT DOCUMENTS

| | | | |
|---|---|---|---|
| 2,119,956 | A | 6/1938 | McDonnell |
| 2,905,315 | A | 9/1959 | Doll |
| 3,004,695 | A | 10/1961 | Foss |
| 3,955,677 | A | 5/1976 | Collingwood |
| 3,973,674 | A | 8/1976 | Postlethwaite |
| 4,189,131 | A | 2/1980 | McCabe |
| 4,212,394 | A | 7/1980 | Alley |
| 4,247,289 | A | 1/1981 | McCabe |
| 4,396,122 | A | 8/1983 | Thimon |
| 4,883,179 | A | 11/1989 | Dionne |
| 5,131,541 | A | 7/1992 | Liebel |
| 5,139,145 | A | 8/1992 | Cook |
| 5,153,402 | A | 10/1992 | Quick et al. |
| 5,441,154 | A | 8/1995 | Youell, III |
| 5,473,995 | A | 12/1995 | Gottlieb |
| 5,577,608 | A | 11/1996 | Hanson et al. |
| 5,604,011 | A | 2/1997 | Morley |
| 5,794,542 | A | 8/1998 | Besaw |
| 5,988,491 | A | 11/1999 | Morrison |
| 6,039,184 | A | 3/2000 | Gale |
| 6,227,366 | B1 | 5/2001 | Eckard et al. |
| 6,305,599 | B2 | 10/2001 | Tsubaki et al. |
| 6,308,850 | B1 | 10/2001 | Coom et al. |
| 6,915,603 | B2 | 7/2005 | Hunt |
| 7,111,734 | B2 | 9/2006 | Robinson, Jr. |
| 7,159,345 | B2 | 1/2007 | Hunt |
| 7,299,924 | B2 | 11/2007 | Robinson, Jr. |
| 2007/0000983 | A1 | 1/2007 | Spurrell et al. |
| 2007/0051787 | A1 | 3/2007 | Schille et al. |

*Primary Examiner* — Alexander Thomas
(74) *Attorney, Agent, or Firm* — Sutherland Asbill & Brennan, LLP

(57) ABSTRACT

The stack-top dunnage can have a sheet having two opposite end sections and a center section therebetween; each end section being successively folded thus forming a thicker ledge portion. The stack-top protector can be placed on top of a stack and the ledges thence receive tie bands that tie the stack to a pallet for shipping.

20 Claims, 4 Drawing Sheets

STACK-TOP DUNNAGE

CROSS-REFERENCE TO RELATED APPLICATION

This specification claims priority of U.S. Provisional application No. 61/108,633 entitled "Stack-top Dunnage" and filed on May 22, 2009 by applicant.

TECHNICAL FIELD

The specification relates to material handling, and more specifically discloses a dunnage for use on a top of a stack.

BACKGROUND OF THE INVENTION

Stacks of material to be shipped, such as stacks of paper sheets for example, are often placed onto a support such as a pallet for shipping. Such stacks are typically tied onto the pallet using bands made of plastic or metal and which contribute to holding the stack together. It was common to place a sheet of wood on top of the stack prior to wrapping the stack with the bands. This was done for two reasons.

First, the rigidity of the wood helps prevent damage to the stacked material, and especially to the uppermost sheets thereof, which can be caused by the bands which are used to wrap the stack. With the sheet of wood in place, the bands are kept spaced apart from the uppermost portions of the stack, and the sheet of wood contributes to even out the pressure exerted by the bands onto a greater surface and reduce the occurrences of high pressure points on the stack.

Second, sometimes the stacks can include a number individual piles of materials. Because the tops of the individual piles are not linked to one another, they can tend to open up, and even fall in opposite directions during shipping. Using a sheet of wood as dunnage on top of two or more such piles, with the bands holding the sheet of wood down onto the piles, serves as a link between the tops of the piles and greatly reduces the possibility that the piles open up during shipping.

Although the use of wood sheets as stack-top dunnage was satisfactory to a certain degree, it did have some inconveniences, such as relatively high costs, weight, and cumbersomeness between uses. There thus remained room for improvement.

SUMMARY OF THE INVENTION

In accordance with one aspect, there is provided a stack-top dunnage comprising: a first component having a first sheet material with a central section between two opposite end sections, the first sheet material being successively folded at each of the two end sections thus forming corresponding ledges on opposite sides of the center section, the ledges being spaced-apart from one another by a first distance; and a second component having a second sheet material with a central section between two opposite end sections, the second sheet material being successively folded at each of the two end sections thus forming corresponding ledges on opposite sides of the center section, the second component having a width to fit between the ledges of the first component.

In accordance with another aspect, there is provided a stack-top dunnage comprising: a first sheet having two opposite end sections and a center section therebetween, each end section having a first number of equal-width, longitudinally adjacent and parallel panels folded atop one another and atop an edge of the center section in an accordion manner, the two folded end sections thus forming corresponding ledges of a first thickness on opposite sides of the center section, and being spaced-apart by a first distance; a second sheet having two longitudinally opposite end sections and a center section therebetween, each end section having a second number of equal-width, longitudinally adjacent and parallel panels folded atop one another and atop an edge of the center section in an accordion manner, the two folded end sections thus forming corresponding ledges of a first thickness on opposite sides of the center section; wherein the second sheet is oriented perpendicularly to the first sheet and positionable into the spacing between the ledges of the first sheet, on the center section of the first sheet, in a manner that the center section of the second sheet is surrounded by the ledges of the first and second sheets.

In accordance with another aspect, there is provided a stack-top dunnage comprising a sheet having two opposite end sections and a center section therebetween; each end section having a number of equal-width adjacent panels folded atop one another in an accordion manner and thus forming a thicker ledge portion, wherein the stack-top dunnage can be placed on top of a stack and the ledges thence receive tie bands that wrap the stack.

In accordance with another aspect, there is provided a method of palletizing paper sheets comprising: positioning sheets of paper in a stack on a pallet; placing a sheet of cardboard having two opposite end sections each having a number of adjacent panels folded atop one another in an accordion manner and thus forming two corresponding thicker ledge portions, on top of the stack and pallet, and wrapping two bands around the stack, one covering each ledge portion, the two bands tying the stack and sheet of cardboard to the pallet.

DETAILED DESCRIPTION

Figure 1:
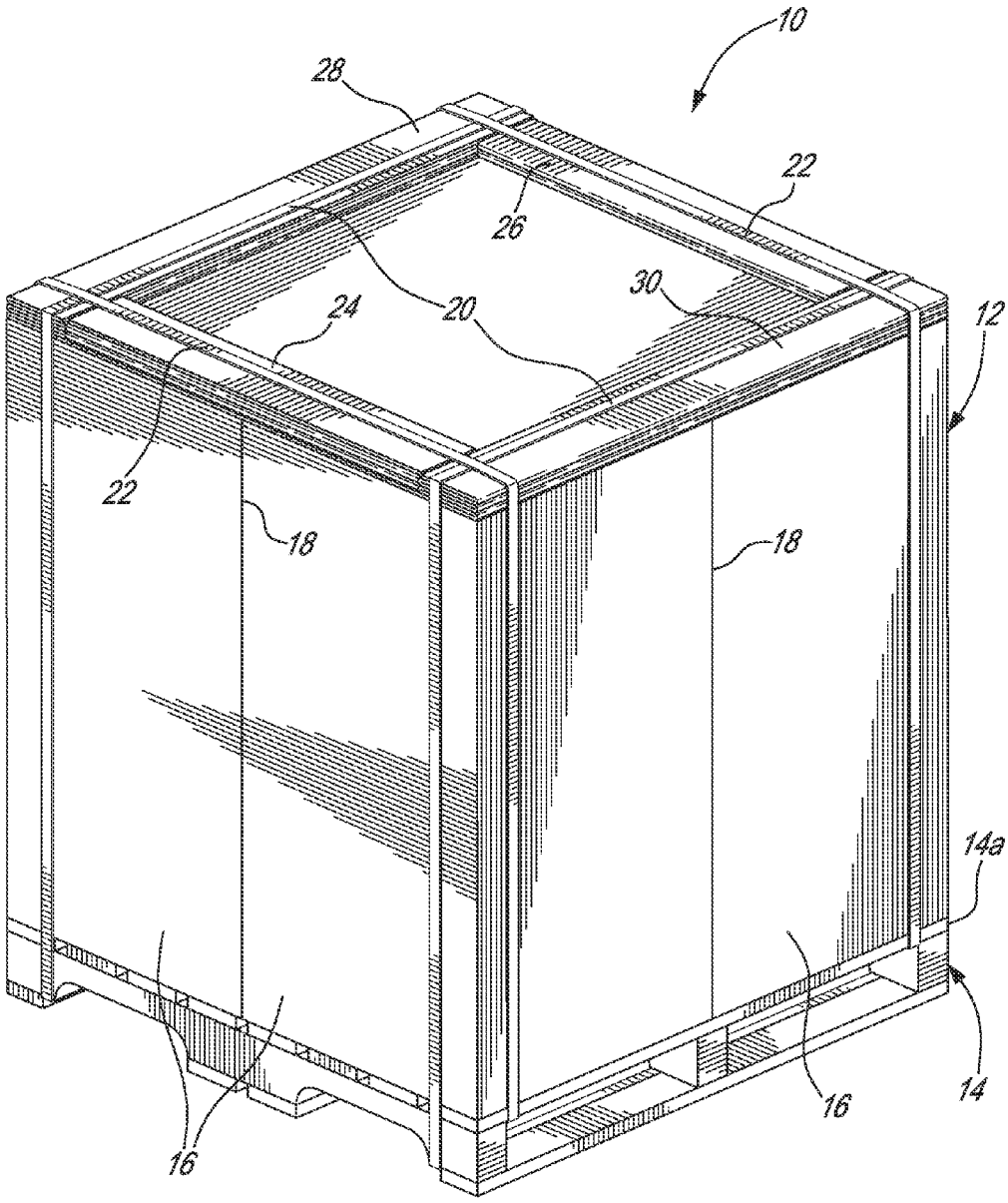
FIG. 1 is a perspective view showing an example of a stack-top dunnage in use on a palletized stack.

FIG. 1 shows an example of a stack-top dunnage 10 in use. The stack-top dunnage 10 is positioned on top of a stack 12, the stack being positioned on a support 14. In this example, the support 14 is a pallet 14*a*, and the stack 12 includes four piles of paper 16, the four piles of paper 16 being adjacent to one another. The stack-top dunnage 10 is positioned on top of the stack 12, and entirely covers the four piles of paper 16, thereby bridging gaps 18 therebetween on the top of the stack 12. In this embodiment, two sets of parallel attachment bands 20, 22 are used to hold the stack-top dunnage 10 and the stack 12 on the pallet 14*a*. The attachments bands 20, 22 are applied onto thicker edge portions, referred to herein as ledges 24, 26, 28, 30 of the stack-top dunnage 10.

Figure 2:
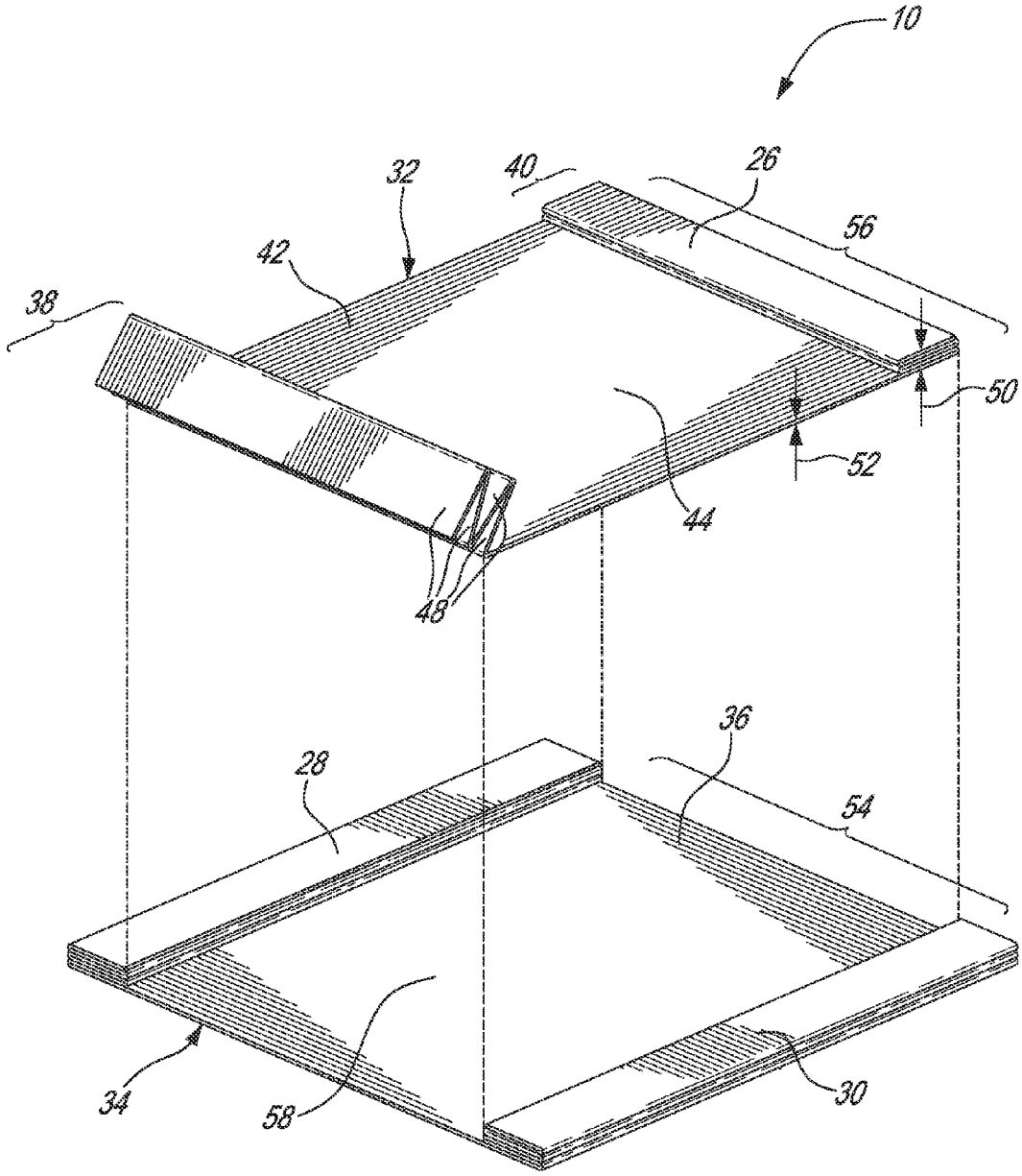
FIG. 2 is an exploded perspective view of the stack-top dunnage of FIG. 1.

Turning to FIG. 2, it will be understood that, in this embodiment, the stack-top dunnage 10 is made of two components, including an second component 32, which is nestably received onto a first component 34. The first component 34 is made from a first sheet 36. The second component 32 is made with a second sheet 42. The second sheet 42 has a center section 44, and two edge sections 38, 40, each edge section 38, 40 being on a respective opposite side of the center section 44. One edge section 40 is shown folded to form a ledge 26 during use, whereas the other edge section 38 is shown partially unfolded, to show the detail of the folds. The partially unfolded edge section 38 can be seen to have a plurality of same width, parallel, and adjacent panels 48 which are folded atop one another and over a portion of the central section 44, thus foldable into a ledge 24 (FIG. 1) having a greater thickness 50 than the thickness 52 of the center portion 44.

Figure 3:
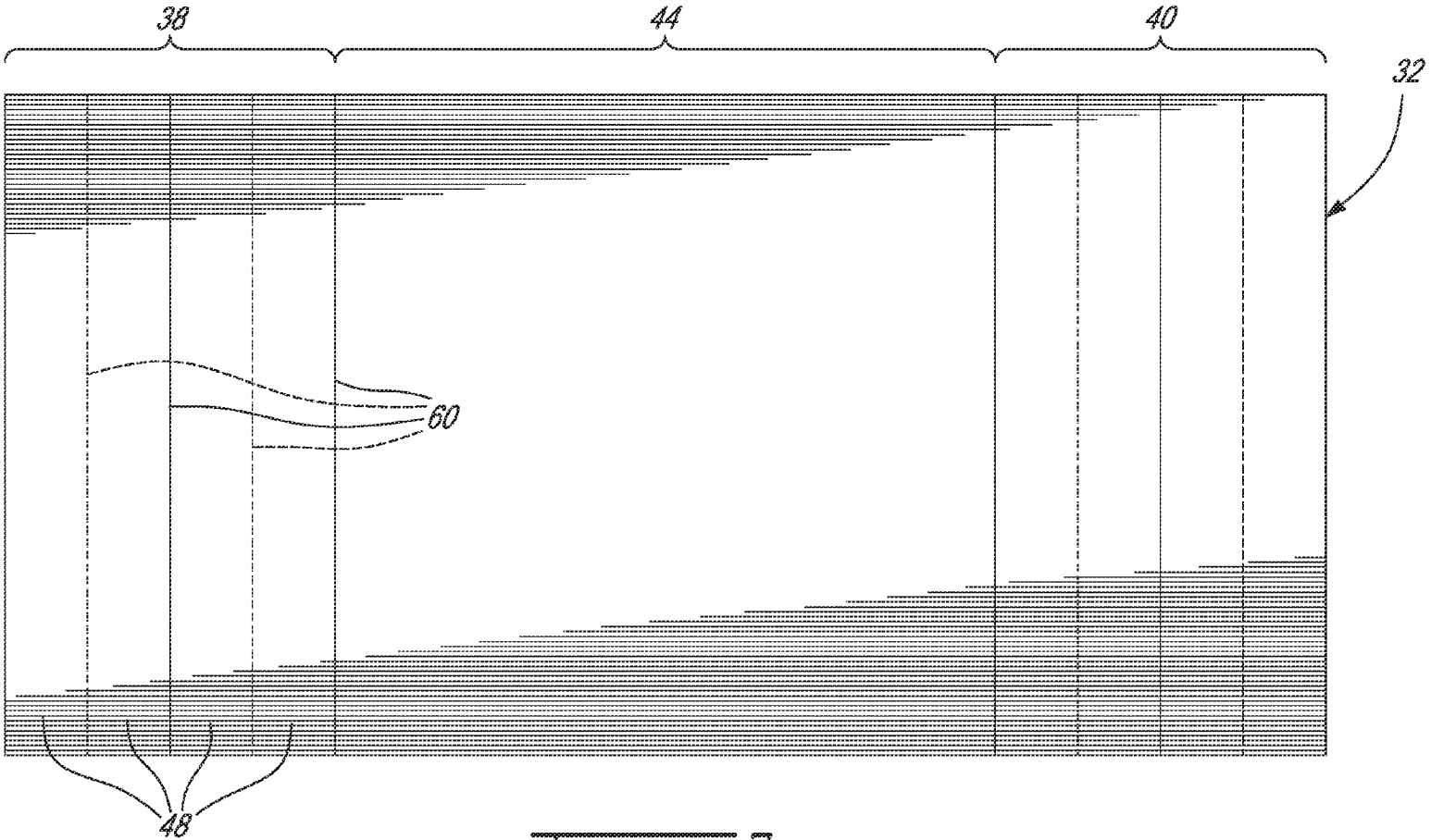
FIG. 3 is a top plan view of the component shown in FIG. 2, in an unfolded state.

The details of the folds are also understandable from FIG. 3 where the blank of the second component 32 is shown in an unfolded state.

Back in FIG. 2, the first component 34, or first component, is made with a first sheet 36 of cardboard material and has a similar construction to that of the second component 32 and therefore does not need to be described in fuller detail. The use of thicker ledges 28, 30, 26 allows to offer a greater resistance along the sides of the stack, where the attachment bands are applied, for a given length of material having a thickness and weight substantially lesser than a panel of wood.

To achieve the configuration shown in FIG. 1, the second component 32, is inserted into the spacing 54 between the ledges 28, 30 of the first component 34. The second component 32 and the first component 34 are oriented perpendicularly to one another. In this example, both the first component 34 and the second component 32 are made from rectangular blanks, the spacing 54 between the ledges 28, 30 of the first component 34 is designed to match the width 56 of the second component 32, and the length of the second component 32 is designed to match the width of the first component 34. These latter features are practical, though it will be understood that they are optional and that for instance, alternate embodiments can have different blank shapes, have a second component width smaller than the spacing, or have a second component length different than the width of the first component. Another particularity of the depicted embodiment is that the first component and second component are made of sheet material having the same thickness, and in order to provide ledges 24, 26, 28, 30 all having the same height when in the configuration shown in FIG. 1, there is one less panel 48 in the folded edge sections 38, 40 of the second component 32 than the amount of adjacent panels folded into the ledges 28, 30 of the first component 34, to account for the thickness of the central portion 58 of the first component 34 which is present underneath the second component 32 during use. The use of four same height ledges 24, 26, 28, 30 is optional, but preferred due to its practicality.

In an alternate embodiment, a single one of the components, such as the first component 34 for example, can be used alone, rather than in the combination disclosed above. In such an alternate embodiment, two attachments bands can still be used along the two opposite ledges 28, 30, instead of four attachment bands such as disclosed above, which can also be satisfactory in some applications.

The sheet material used in making the first and/or second components will typically be a cellulose pulp sheet material. It can be a cardboard for instance, or a sheet material having at least a layer of cellulose pulp felt. The cardboard can have one layer or more of paperboard and fluted sheet. The paperboard have between 1 and 12 plies, and can be a chipboard, a solidboard, and a box board for instance. The cellulose pulp sheet material can have more than one layer in which case liners can be used.

Turning now to FIG. 3, to achieve a satisfactory folding capability of the sheet material, and more particularly the end sections 38, 40 thereof (particularly when using heavy paperboard such as chipboard), slits can be defined into the blank, opposite the folds. This is shown schematically in FIG. 3, where slits 60 cut into the exposed side of the cardboard blank are shown in full lines, and slits 60 cut into the opposite side of the cardboard blank are depicted in dotted lines. Folding sequentially along the adjacent slits allows to form the ledges 24, 26. The slits are made on a predetermined side of the blank and the folds are practiced in a manner that the slits 60 open up and face outwardly from the folds.

The ledges 24, 26, 28, 30 can be held into the folded configuration simply by the application of the attachment bands 20, 22 if desired. Alternately, the adjacent panels 48 folded into the ledge 24 can be fixed to one another either by using an adhesive or with fasteners, for example. Optionally, a cohesive adhesive can be used to hold the accordion folded ledge into the folded configuration. A cohesive adhesive is a type of adhesive which is usually not adherent, but which is activated when applied to another surface which is also covered by it. In this application, for example, a cohesive adhesive could be applied entirely to both surfaces of the cardboard blank, could cover only the end portions of the cardboard blank, or can be applied in bands at specific areas of the end portions, on both sides thereof, in a manner that when folded, each one of the adjacent panels has a cohesive covered surface which comes into contact with a cohesive covered surface of an adjacent panel.

Embodiments such as described above can conveniently be partially or completely produced online. For instance, it is possible in the process of making the sheet material to optionally add rollers which apply cohesive adhesive at selected areas, and to optionally add blades which define slit lines at selected places, for instance. The components can thereafter be trimmed to width and the edge portions be folded into place by an operator, for instance.

Figure 4:
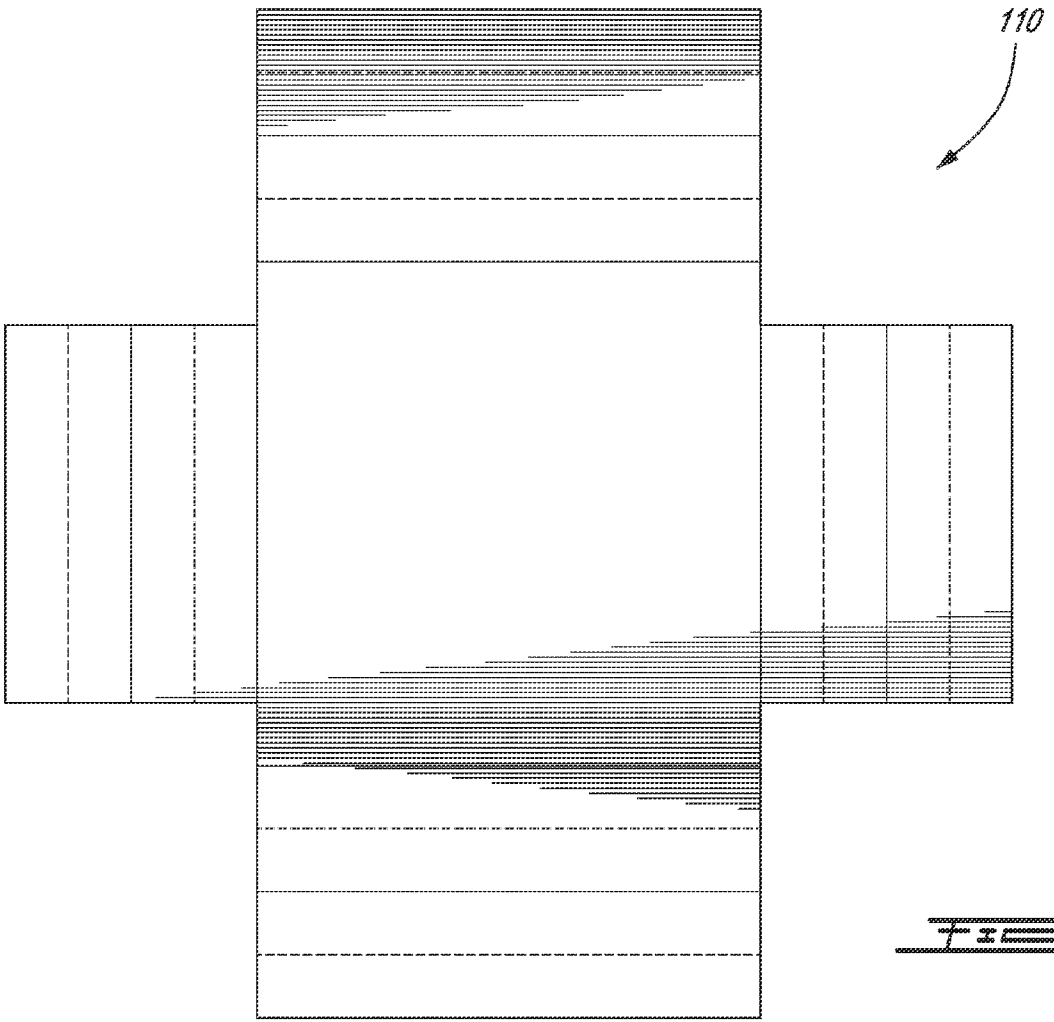
FIG. 4 is a top plan view of an alternate embodiment of the stack-top dunnage in an unfolded state.

Turning now to FIG. 4, still another embodiment of a stack-top dunnage 110 is shown. In this embodiment, a single cardboard blank having a cross shape is used, and fold lines therein are designed in a manner that each one of four edge sections can be folded in an accordion manner to form a corresponding ledge, to finally arrive in a four ledge configuration similar to the embodiment shown in FIG. 1.

For illustrated purposes, sheets of cellulose pulp based material having a thickness between 60 and 160 pts (1.5 to 4 mm) have been found suitable for the applications described above, preferably between 60 and 120 pts (1.5 to 3 mm). The optional slits to ease the folding of the adjacent panels into the ledges can be cut into a depth having between 60 and 80% of the thickness of the sheet for example. The slits can particularly be useful if using heavy paperboard such as chipboard for instance, or a felt, in which cases liners can also be used. Paperboards having of 2 to 12 ply, for example, preferably 2 to 5, can be used. The number of adjacent panels in the folded against one another into the ledges can be of 2 to 20, or preferably 3 to 10 or 4 to 10, for example, and will depend on the thickness of the material used. Many various embodiments can be realized as well.

The scope is indicated by the appended claims.

What is claimed is:

1. A stack-top dunnage comprising:

a first sheet having two opposite end sections and a center section therebetween, each end section having a first number of equal-width, longitudinally adjacent and parallel panels folded atop one another and atop an edge of the center section in an accordion manner, the two folded end sections thus forming corresponding ledges of a first thickness on opposite sides of the center section, and being spaced-apart by a first distance; and a second sheet having two longitudinally opposite end sections and a center section therebetween, each end section having a second number of equal-width, longitudinally adjacent and parallel panels folded atop one another and atop an edge of the center section in an accordion manner, the two end sections thus forming corresponding ledges of a second thickness on opposite sides of the center section;

wherein the second sheet is oriented perpendicularly to the first sheet and positionable into the spacing between the ledges of the first sheet, on the center section of the first sheet, in a manner that the center section of the second sheet is surrounded by the ledges of the first and second sheets.

2. The stack-top dunnage of claim 1 wherein the first sheet and the second sheet are both cardboard sheets and the second sheet has a width which corresponds to the first distance spacing between the ledges of the first sheet.

3. The stack-top dunnage of claim 1 wherein the first sheet and second sheet are made of the same sheet material and have the same thickness.

4. The stack-top dunnage of claim 1 wherein the first sheet and second sheet each have a thickness of between 1.5 and 4 mm.

5. The stack-top dunnage of claim 1 wherein the adjacent panels are folded along fold lines having slits defined externally to the fold.

6. The stack-top dunnage of claim 1, wherein the first sheet and the second sheet both have the same thickness, and the second number is equal to the first number minus one, in a manner that the ledges of the first sheet and the second sheet have the same height when in position.

7. The stack-top dunnage of claim 6 wherein the first number is between 4 and 10, inclusive.

8. The stack-top dunnage of claim 1 wherein the folded adjacent and parallel panels of the first sheet of cardboard and of the second sheet of cardboard are adhered together with a cohesive adhesive.

9. A stack-top dunnage comprising:

a first component having a first sheet material with a central section between two opposite end sections, the first sheet material being successively folded at each of the two end sections thus forming corresponding ledges on opposite sides of the center section, the ledges being spaced-apart from one another by a first distance; and a second component having a second sheet material with a central section between two opposite end sections, the second sheet material being successively folded at each of the two end sections thus forming corresponding ledges on opposite sides of the center section, the second component having a width to fit between the ledges of the first component.

10. The stack-top dunnage of claim 9 wherein the first sheet material has the same thickness than the second sheet material.

11. The stack-top dunnage of claim 9 wherein the first sheet and second sheet each have a thickness of between 1.5 and 4 mm.

12. The stack-top dunnage of claim 9 wherein the ledges of the first component have the same first thickness, the ledges of the second component have the same second thickness.

13. The stack-top dunnage of claim 9 wherein the second sheet is oriented perpendicularly to the first sheet and positioned in the spacing between the ledges of the first sheet, on the center section of the first sheet.

14. The stack-top dunnage of claim 13 wherein the center section of the second sheet is surrounded by the ledges of the first and second sheets.

15. The stack-top dunnage of claim 13 wherein the ledges all have the same thickness when the second sheet is in said position.

16. The stack-top dunnage of claim 9 wherein the width of the second component is equal to the first distance, and a length of the second component is equal to a width of the first component.

17. The stack-top dunnage of claim 9 wherein the first sheet and second sheet are both made of a cellulose pulp based sheet material having at least one layer of at least one of chipboard, fluted sheet, and felt.

18. A stack-top dunnage comprising:

a first sheet and a second sheet, each one of the first sheet and the second sheet having two opposite end sections and a center section therebetween; each end section of the first sheet and the second sheet having a plurality of equal-width adjacent panels folded atop one another in an accordion manner and thus forming a thicker ledge portion, the first sheet and the second sheet being superposed with the ledge portions of the first sheet being oriented normal to the ledge portions of the second sheet, wherein the stack-top dunnage can be placed on top of a stack and the ledges thence receive tie bands that wrap the stack.

19. The stack-top dunnage of claim 18 wherein the sheet is cardboard having a thickness between 1.5 and 4 mm.

20. The stack-top dunnage of claim 18 wherein all the ledge portions have the same thickness.

* * * * *